United States Patent [19]

Kamoda

[11] Patent Number: 4,495,865

[45] Date of Patent: Jan. 29, 1985

[54] PLATE CLAMPING DEVICE OF WEB-FED ROTARY PRINTING PRESS

[75] Inventor: Hiroyoshi Kamoda, Kashiwa, Japan

[73] Assignee: Komori Printing Machinery Co., Ltd., Tokyo, Japan

[21] Appl. No.: 619,682

[22] Filed: Jun. 11, 1984

Related U.S. Application Data

[63] Continuation of Ser. No. 475,537, Mar. 15, 1983.

[51] Int. Cl.[3] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 1,217,524 | 2/1917 | Story | 101/415.1 |
| 3,382,799 | 5/1968 | Westerly . | |
| 3,727,551 | 4/1973 | Kostas et al. . | |
| 4,104,968 | 8/1978 | Schwaab et al. . | |

FOREIGN PATENT DOCUMENTS

| | | | |
|---|---|---|---|
| 2545124 | 4/1977 | Fed. Rep. of Germany | 101/415.1 |
| 1556389 | 11/1979 | United Kingdom | 101/415.1 |

*Primary Examiner*—Edgar S. Burr
*Assistant Examiner*—Charles A. Pearson
*Attorney, Agent, or Firm*—Charles E. Pfund

[57] ABSTRACT

In a plate clamping device of a web-fed rotary printing press, a plate cylinder is provided with a longitudinal slot having a narrow opening opened on the peripheral surface of the plate cylinder, a semicircular bottom surface and oppositely inclined surfaces interconnecting side walls of the opening and opposite ends of the semicircular bottom surface. A plate clamping shaft having a flat surface and a slit is loosely inserted in the slot. After inserting one bent end of a printing plate wrapped about the plate cylinder between one inclined surface and the flat surface of the plate clamping shaft and the other bent end into the slit the plate clamping shaft is rotated to tightly fasten the printing plate. Reverse rotation of the plate clamping shaft is prevented by releasable pawls. With this plate clamping device it is possible to tightly fasten the printing plate regardless of its thickness.

3 Claims, 6 Drawing Figures

PLATE CLAMPING DEVICE OF WEB-FED ROTARY PRINTING PRESS

This application is a continuation of application Ser. No. 475,537, filed Mar. 15, 1983.

BACKGROUND OF THE INVENTION

This invention relates to a plate clamping device for mounting a printing plate on a plate cylinder of a web-fed rotary printing press.

In a conventional web-fed rotary printing press, a printing plate wrapped about a plate cylinder is mounted under tension on the plate cylinder by clamping the opposite ends of the printing plate between the inner walls of an axial slot formed on the periphery of the plate cylinder and a plate clamping shaft disposed in the slot and then rotating the plate clamping shaft. After clamping, the printing plate should be uniformly tensioned in all directions, and the clamp should not be loosened to release the printing plate for preventing register errors during printing.

In a conventional plate clamping device, an eccentric plate clamping shaft is journalled by bearers at both longitudinal ends of the plate cylinder, and the opposite ends of the printing plate are inserted into gaps between the plate clamping shaft and the inner walls of the slot so as to clamp the printing plate by the wedge action of the plate clamping shaft caused by the tension of the printing plate. As a consequence, the long plate clamping shaft journalled at its opposite ends has a tendency to be bent by the tension of the printing plate so that the printing plate is not wrapped under uniform tension. Where the thickness of the printing plate is small, sufficient clamping force can not be provided, whereas where the thickness of the printing plate is large, insertion of both ends thereof into the gaps becomes difficult. Accordingly, it is difficult to set the gaps for any thickness of the printing plate. In other words the range of the thickness of the printing plate is limited.

SUMMARY OF THE INVENTION

It is an object of this invention to provide an improved plate clamping device of a web-fed rotary printing press capable of firmly clamping the printing plate regardless of the thickness thereof.

According to this invention, there is provided a plate clamping device of a web-fed rotary printing press comprising a plate cylinder; a printing plate wrapped about the plate cylinder, the plate cylinder being provided with a longitudinal slot having a narrow opening opened on a peripheral surface of the plate cylinder, a semicircular bottom surface and oppositely inclined surfaces interconnecting side walls of the opening and opposite ends of the semicircular bottom surface; a plate clamping shaft loosely inserted into the slot and formed with a plurality of radial openings each containing a ball and a spring urging the ball against the semicircular surface, the peripheral surface of the plate clamping shaft being provided with a flat surface which cooperates with one of the inclined surface to hold one bent end of the printing plate and a slit for receiving the other bent end of the printing plate.

DESCRIPTION OF THE PREFERRED EMBODIMENT

Figure 1:
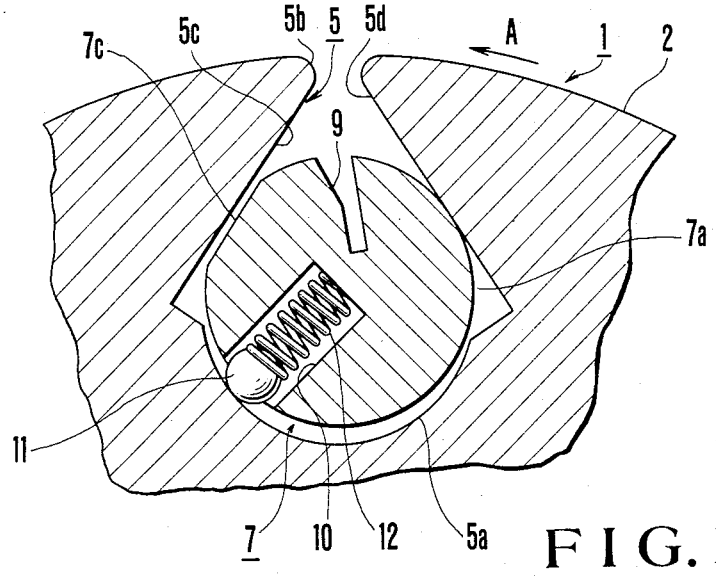
FIG. 1 is a cross-sectional view showing one embodiment of the plate clamping device of a web-fed rotary printing press embodying the invention.

Referring now to the accompanying drawings, a plate cylinder 1 is constituted by assembling a cylindrical main body 2, a pair of circular disc shaped bearers 3 and end shafts 4 on the opposite sides of the main body 2. A longitudinal groove or slot 5 is axially provided on the periphery of the main body 2. The slot 5, as clearly shown in FIG. 1, has a cross-sectional configuration having a semicircular bottom surface 5*a*, a narrow opening 5*b* at the peripheral surface of the main body 2, and oppositely inclined surfaces 5*c* and 5*d* interconnecting both sides of the narrow opening 5*b* and the opposite ends of the semicircular surface 5*a*, the opposing ends of the periphery defining the narrow opening 5*b* being rounded. Each of bearers 3 arranged on the both sides of the main body 2 is formed with a shaft opening 6 which is concentric with the semicircular surface 5*a* in the main body 2.

A plate clamping shaft 7 is provided for clamping the circumferential opposite ends of a printing plate 8 wrapped about the periphery of the plate cylinder 1. The plate clamping shaft 7 has a large diameter portion 7*a* with a diameter slightly smaller than a circle contacting the inner surfaces of the slot 5 and opposite shaft portions 7*b* each of which has a diameter slightly smaller than the shaft opening 6 of the bearer 3 so that the plate clamping shaft 7 is loosely received in the slot 5. The large diameter portion 7*a* is provided with a flat portion 7*c* parallel with the inclined surface 5*c* of the slot 5 and adapted to clamp one inwardly bent end of the printing plate, the flat portion 7*c* extending over substantially the entire length of the slot 5 except the opposite ends thereof. A cylindrical portion of the large diameter portion 7*a* is provided with a longitudinal slot 9 for receiving one end of the printing plate, and a plurality of radial openings 10 longitudinally spaced apart from each other, each of said openings 10 accommodating a ball 11 and a compression spring 12 urging the ball 11 against the semicircular surface 5*a* of the slot 5.

Figure 3:
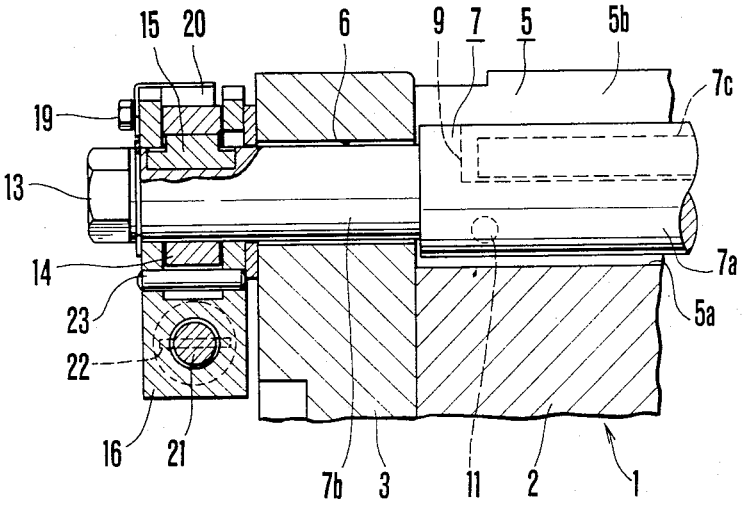
FIG. 3 is a cross sectional view taken on line III—III of FIG. 2.

As shown in FIG. 3, both ends 13 of opposite shaft portions 7*b* are formed in the shape of a nut or the head of a bolt, so that the nut shaped ends 13 is adapted to be engaged by a spanner for rotating the plate clamping shaft 7. A ratchet wheel 14 having a plurality of teeth is secured to each of the small diameter opposite shaft portions 7*b* by a key 15 adjacent to each end 13. U shaped pawl levers 16 are rotatably mounted on the opposite sides of the ratchet wheel 14. A pawl 17 is pivotably supported by the pawl lever 16 through a pin 18 at the free ends of the pawl levers 16 and urged by a leaf spring 20 secured to the pawl levers 16 by a bolt 19 for causing the pawl 17 to engage with the teeth of the ratchet wheel 14. When the pawl 17 is rotated against the force of the leaf spring 20 in the clockwise direction by pushing a knob 17*b*, a flat portion 17*a* is brought to a position contacting the leaf spring 20 at which the rotation of the pawl 17 stops. A tightening screw 21 is threaded through the other ends of the pawl levers 16 to reach the periphery of the end shaft 4 so that the rotation of the pawl levers 16 can be adjusted by adjusting the screw 21. A stop 22 is provided with the tightening screw 21 for preventing the same from disengaging the pawl levers 16, and a pin 23 engaging a small diameter portion 14*a* of the ratchet wheel 14 is provided for the ratchet levers 16.

The plate clamping device having a construction as above described operates as follows.

Before mounting a new printing plate, a used printing plate wrapped about the plate cylinder is dismounted. First, the tightening screws 21 of the rachet mechanisms on both sides are loosened with a screw driver, for example, until the stop 22 engages shoulders 16*a* of the pawl levers 16. Thereafter the pawl 17 is manually rotated by pushing the knob 17*b* of the pawl 17 in the clockwise direction of arrow B so that the flat portion 17*a* of the pawl 17 is forced by the leaf spring 20 to hold its state. In such state the rachet wheels 14 are disengaged from the pawls 17 to rotate freely.

Figure 2:
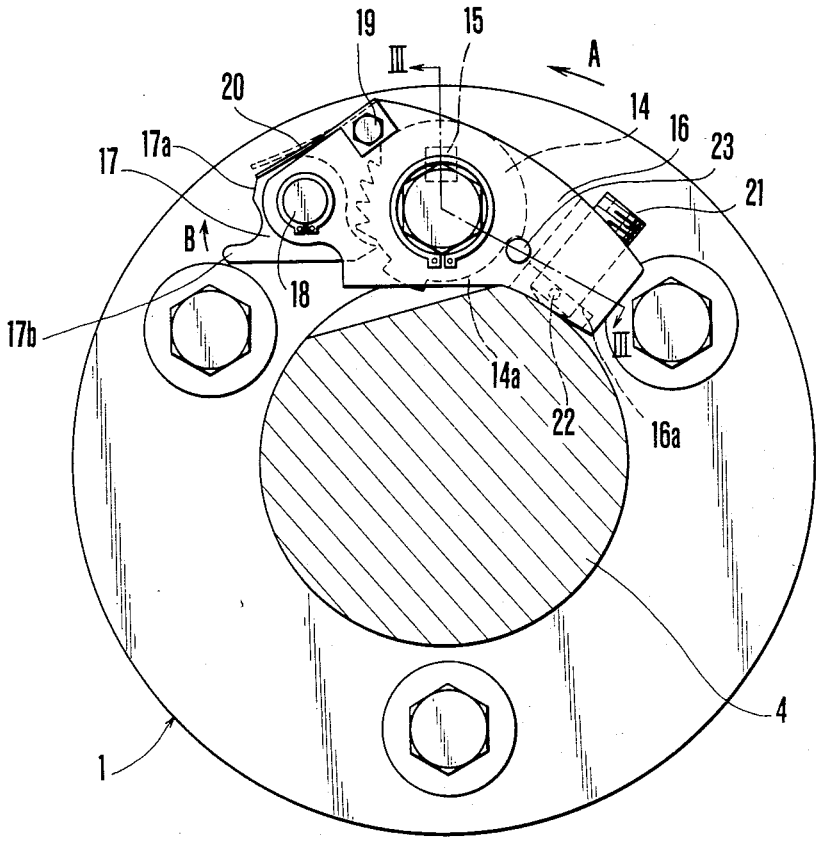
FIG. 2 is a side view showing a plate cylinder.
Figure 4:
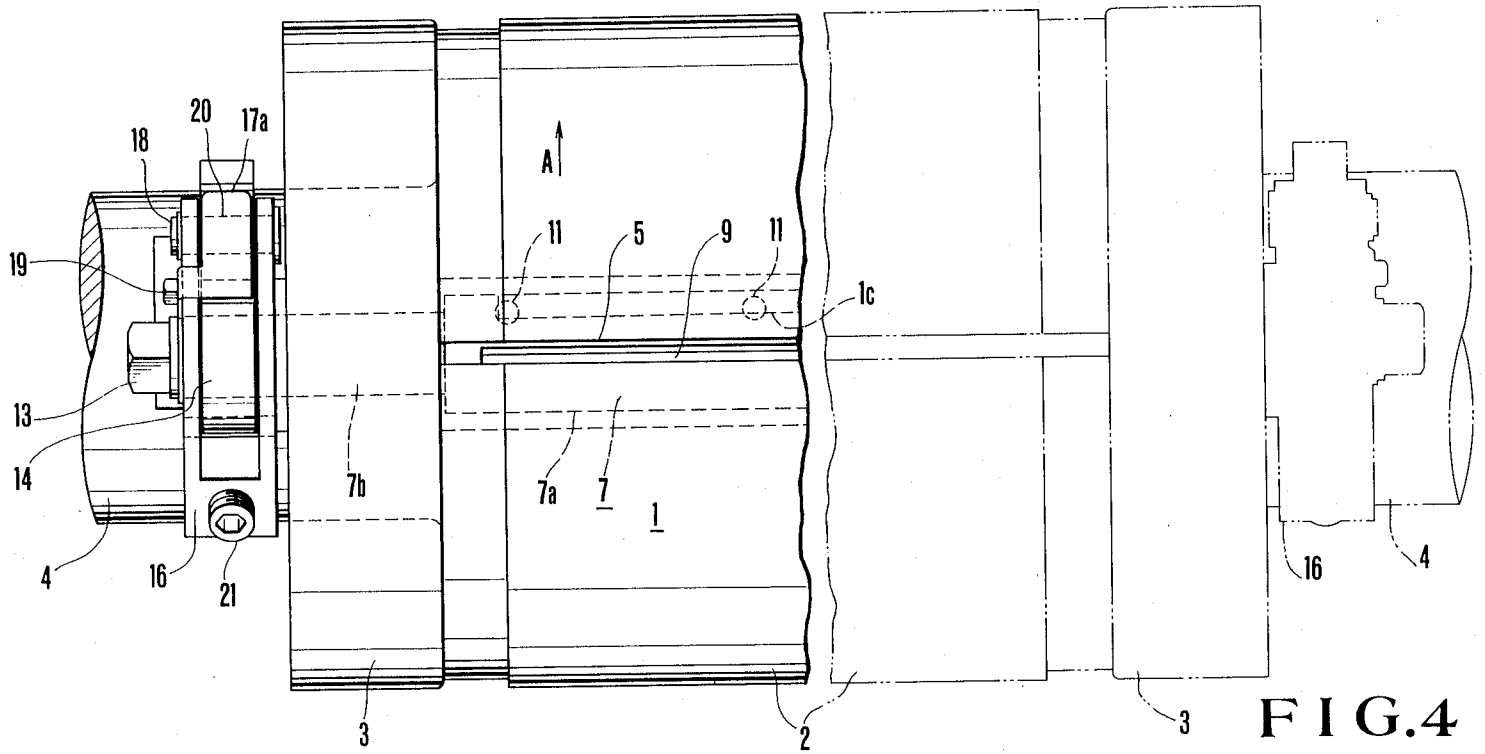
FIG. 4 is a schematic plan view of the plate cylinder partially in phantom.

The used printing plate 8 wrapped about the plate cylinder is dismounted by a suitable prior known manner. FIG. 2 shows status of the mechanism when the used printing plate 8 is dismounted.

Figure 5:
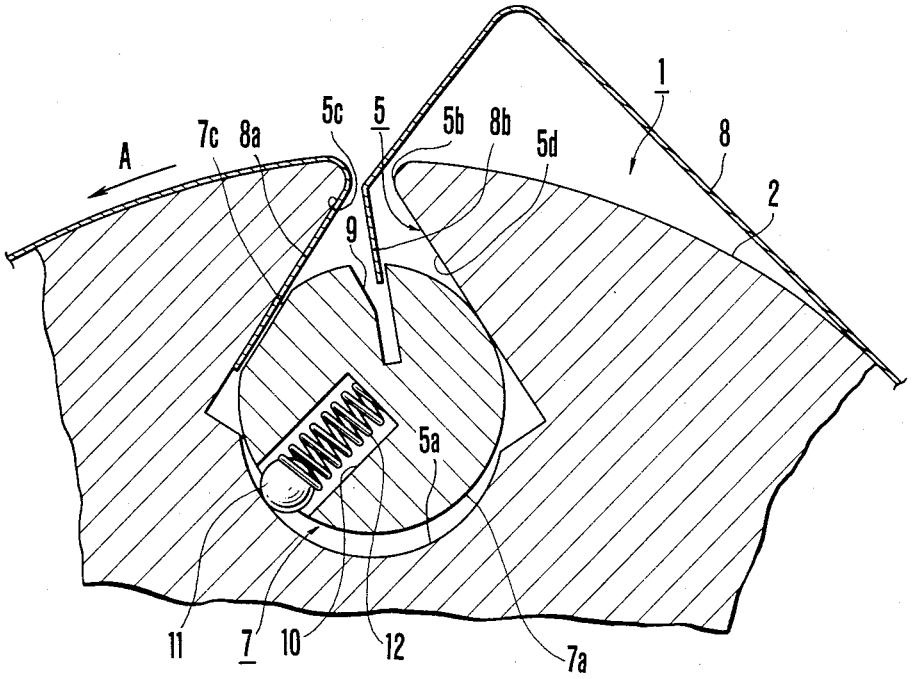
FIGS. 5 and 6 are enlarged partial cross-sectional views useful to explain the construction and operation of the plate clamping device according to this invention.
Figure 6:
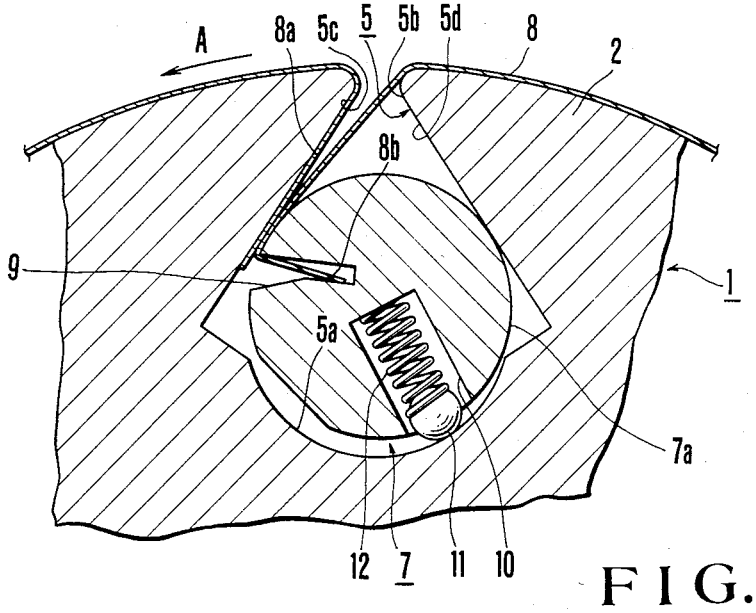

Next, for mounting a new printing plate, the knob 17*b* of the pawls 17 is pushed in the counterclockwise direction to engage the pawls 17 with the ratchet wheels 14. Thereafter the ratchet wheels 14 are rotated to the position shown in FIG. 2 by manually operating the spanner engaged with one or both of the ends 13 of the shaft portions 7*b* until the pawls 17 engage the teeth of the ratchet wheels 14. Usually the printing plate 8 is made of a thin sheet of steel or aluminum having a thickness of 0.22–0.3 mm and the both ends of the printing plate 8 are bent inwardly as shown in FIG. 5. Since the flat portion 7*c* of the plate clamping shaft 7 is parallel with the inclined surface 5*c* of the slot 5, one bent end of the printing plate 8 is inserted between the flat portion 7*c* and the inclined surface 5*c* of the slot 5. At this time, since the ball 11 is urged by spring 12 against the left-hand portion of the semicircular portion 5*a* as viewed in FIG. 5, the plate clamping shaft 7 is urged against the right-hand inclined surface 5*d* of the slot 5 by a reaction force, while the flat surface 7*c* is urged against the inclined surface 5*c* with a slight pressure. Then the bent end 8*a* of the printing plate 8 can readily be inserted by pressing the plate clamping shaft 7 to right lower and the inserted end 8*a* is held with a suitable force. After holding one end 8*a* of the printing plate 8 in this manner, the printing plate 8 is wrapped about the plate cylinder 1. Then the other bent end 8*b* of the printing plate 8 is inserted into slot 9, and the plate clamping shaft 7 is rotated in the counterclockwise direction as viewed in FIG. 1 by rotating the end 13 with a spanner. Then, the slot 9 is brought to oppose the inclined surface 5*c* to overlap both bent ends 8*a* and 8*b* of the printing plate and the overlapped ends are held between the inclined surface 5*c* and the plate clamping shaft 7 as shown in FIG. 6. At this time, since the balls 11 move along the semicircular surface 5*a* toward right lower, the reaction force caused by the balls 11 engaging the semicircular surface 5*a* now acts upon the left-hand inclined plane 5*c*. As a consequence, as the bent ends 8*a* and 8*b* of the printing plate 8 are more deeply pulled in, the pressure applied to the overlapped ends of the printing plate 8 increases to firmly hold the printing plate 8. As the plate clamping shaft 7 is rotated, the ratchet wheels 14 integral therewith are rotated by operating the spanner at the end 13 of the shaft portion 7*b* so that the pawls 17 would engage other teeth, spaced 4 teeth in this embodiment, to prevent reverse rotation of the plate clamping shaft 7. Thereafter, as the tightening screw 21 is manually rotated, the pawl levers 16 are rotated in the counterclockwise direction to rotate the ratchet wheels 14 in the tightening direction while engaging with the pawls 17, whereby the printing plate 8 will be further tightened.

As above described, according to this invention, a plate cylinder is provided with a longitudinal slot having a semicircular bottom portion, a narrow opening and oppositely inclined surfaces interconnecting the semicircular portion and the narrow opening, and a plate clamping shaft having a diameter slightly smaller than that of a circle contacting the semicircular surface and both inclined surfaces is loosely inserted in the slot. The bent ends of the printing plate are clamped by urging the plate clamping shaft against the inclined surfaces by the reaction force created by spring biased balls rolling along the semicircular surface. Consequently, when one bent end of the printing plate is inserted between an inclined surface of the slot and the plate clamping shaft, the urging force of the plate clamping shaft loosely inserted into the slot acts on the surface opposite to the surface clamping one end of the printing plate and does not act strongly upon the clamping surface, so that the printing plate is held by a suitable force. Accordingly even when the thickness of the printing plate is relatively large, the bent ends thereof can readily be inserted. Moreover, as the gap receiving the bent ends varies in accordance with the thickness of the printing plate it is not necessary to precisely finish the clamping surfaces. Moreover, when the printing plate is tightened by rotating the plate clamping shaft, the point of applying pressure by the ball moves to apply the pressure caused by the plate clamping shaft upon the clamping surfaces. Consequently, it is possible to firmly clamp the printing plate irrespective of its thickness, thus improving the quality of the printed matter.

What is claimed is:

1. A device for clamping a printing plate having first and second ends adapted to be held by clamping means on a web-fed rotary printing press comprising:

a plate cylinder, said plate cylinder being provided with a longitudinal slot having a narrow opening on a peripheral surface of said plate cylinder, said slot having a cross section formed by a semicircular bottom surface, outward diverging surfaces extending from the edges of said semicircular bottom and first and second oppositely inclined converging plane side walls interconnecting opposite edges of said opening and said diverging surfaces;

a round plate clamping shaft in said slot sized to provide substantial clearance from the inner walls of said slot thereby to loosely fit into said slot beneath the peripheral surface of said plate cylinder, said plate clamping shaft having: a plurality of radially projecting spring loaded balls contacting said semicircular bottom to urge said shaft against said converging side walls as said shaft is rotated each of said balls being partially contained in an opening in said shaft, a peripheral surface including a flat surface generally parallel to the radial direction of movement of said spring loaded balls, the flat surface in a first position of rotation of said shaft allowing space for said first end of said printing plate to being inserted between said first side wall and said shaft, and a groove in said shaft opposed to said opening when said shaft is in said first position for receiving said second end of said printing plate;

wherein for said first position said spring loaded balls urge said plate clamping shaft against said second side wall to provide said space for said first end of said printing plate to be inserted between said first side wall and the flat surface of said shaft, and wherein for a second position of rotation of said shaft said spring loaded balls urge said plate clamping shaft against both said first and second walls to hold both ends of said printing plate securely between said first side wall and said shaft.

2. The clamping device according to claim 1 further comprising a ratchet wheel mounted on at least one end of said plate clamping shaft and a pawl engaging said ratchet wheel.

3. The clamping device according to claim 2 wherein said pawl is pivotally supported by a pawl supporting lever and said pawl supporting lever is adjustably fastened to the plate clamping shaft on at leat one side of said plate cylinder.

* * * * *

UNITED STATES PATENT AND TRADEMARK OFFICE

CERTIFICATE OF CORRECTION

PATENT NO. : 4,495,865

DATED : January 29, 1985

INVENTOR(S) : Hiroyoshi Kamoda

It is certified that error appears in the above-identified patent and that said Letters Patent are hereby corrected as shown below:

Claim 2, col. 6, l. 6: before "clamping device" insert --plate--

Claim 3, col. 6, l. 10: before "clamping device" insert --plate--

Claim 3, col. 6, l. 12: after "lever" (first occurrence) insert--on both sides thereof--

Claim 3, col. 6, l. 13: change "leat" to --least--

Signed and Sealed this

*Twenty-sixth* Day of *November 1985*

[SEAL]

*Attest:*

DONALD J. QUIGG

*Attesting Officer*

*Commissioner of Patents and Trademarks*